United States Patent [19]

Lamort

[11] Patent Number: 4,938,423

[45] Date of Patent: Jul. 3, 1990

[54] PAPER PULP BEATER

[75] Inventor: Jean P. Lamort, Vitry, France

[73] Assignee: E & M Lamort, Vitry le Francois, France

[21] Appl. No.: 339,734

[22] Filed: Apr. 18, 1989

[30] Foreign Application Priority Data

Apr. 18, 1988 [FR] France ..... 88 05103

[51] Int. Cl.[5] ..... B02C 17/16

[52] U.S. Cl. ..... 241/46.17

[58] Field of Search ..... 162/4, 261; 241/46.17, 241/46 R, 46.02, 46.04, 172

[56] References Cited

U.S. PATENT DOCUMENTS

| | | | |
|---|---|---|---|
| 1,958,020 | 5/1934 | Robinson . | |
| 3,486,702 | 12/1969 | Kmeco | 241/46.17 |
| 3,506,202 | 4/1970 | Cumpston, Jr. . | |
| 4,593,861 | 6/1986 | Blakley et al. | 241/46.17 X |
| 4,725,007 | 2/1988 | Chupka | 241/46.17 X |

FOREIGN PATENT DOCUMENTS

| | | |
|---|---|---|
| 122991 | 2/1985 | European Pat. Off. . |
| 2441681 | 1/1983 | France . |
| 2543183 | 9/1984 | France . |
| 2544756 | 10/1984 | France . |

*Primary Examiner*—Mark Rosenbaum
*Attorney, Agent, or Firm*—Darby & Darby

[57] ABSTRACT

Paper pulp beater of the type having a cylindrical vat, open at its upper part, and closed by a bottom equipped with a rotor over which rises a vertical shaft extending along the central axis of revolution of the vat in the interior of the vat, the lateral wall of the vat having a device for force recirculation of the pulp, in that the recirculation device (7) includes at least one surface element (8, 21) extending substantially circularly along the wall (9) of the beater, running from the wall toward the interior of the vat (1) and toward the upper opening (20) of the beater, over a constant distance (12, 22) so as to form a band of constant width, one of the faces (24) of the element being oriented toward the bottom of the vat, so that the pulp (6) encountering this face (24) is diverted into the interior of the vat in a single direction (FIG. 3).

19 Claims, 1 Drawing Sheet

PAPER PULP BEATER

The present invention relates to a paper pulp disintegration device and notably to a beater for paper pulp.

The disintegration of paper consists in transforming the paper from the dry and solid state to the pasty state in the presence of water.

Two processes are currently being used—the chipping beater process and the disintegrating beater process.

Chipping beaters have a rotor at the bottom of a vat and knives placed either on the bottom and lateral walls, or on the rotor itself, these arrangements being combined with one another to obtain the best efficiency. In this process the paper is cut into small fragments as are also the foreign bodies that must be removed in the subsequent treatments of refining the pulp.

The disintegrating beaters, better known under the name of "helico", usually have a vertical rotor located at the bottom of the vat, formed by a stuffing screw that ends in a centrifugal turbine taking along the paper in a violent movement, and this paper is disintegrated by fiber-on-fiber friction.

Such a beater is described in French patent FR-A-2 544,756 of the applicant.

In this process the paper is not chipped and the impurities remain whole, thus leaving, for example, plastic sheets in the mass of the pulp. These impurities are sorted out in attached devices described in French patents FR-A 2 441,681 and FR-A 2 543,183.

This process gives good results, and notably the beater described in the aforesaid patent permits disintegrating a mixture of papers having a density ranging from 15 to 20% dried substance.

But it is practically impossible to increase the density, that is, to treat more paper at the same time, because, if a greater quantity of paper is added (for the same quantity of water), it is necessary to increase the power of the motor to avoid packing and to treat the mass in a comparable period of time, or if packing does not occur, the treatment time must be increased considerably so that in the end the gain is imperceptible if it exists.

On the other hand, as the material rises along the wall without falling back to the center, the rotor rotates at no load, and when detaching from the wall it causes shocks which damage the motor.

Consequently, for economic reasons as well as because of difficulties of operation, the density of 20% dry substance cannot be exceeded.

European patent EP A 0 122,991 describes a solution to this problem. The wall of material that tends to rise along the wall of the beater is divided and is redirected toward the center of the vessel. The organs which deflect and divide the wall of material consist of three deflectors or studs 100 of pyramidal form, disposed on the wall of the beater. Each stud presents four faces of generally triangular form, the two lower studs forming deflectors. The pyramids are symmetrical, and disposed in such a way that the lower faces are symmetrically inclined downward at the same angle, one to the left, the other to the right, so that as it rises along the wall, the wall of material divides on these two faces into two portions.

This device, while it prevents the material from remaining attached to the wall of the beater and prevents the rotor from rotating at no load, nevertheless presents the disadvantage of not properly mixing the entire material. In fact, in dividing the outflow into three streams 101, the portion of the material which is not deflected, 102, remains attached to the wall, while the rest is recirculated, as is shown in FIG. 1. The material present in these zones of less agitation is therefore less well treated than the rest, resulting in heterogeneous disintegration.

The objective of the present invention is an improvement in beaters, whether of the helico model or not, which permits treating a much denser paper mass, up to 25% of dry substance, or an increase of 25% of the current performance, by forced recirculation of the pulp.

The object of the invention is an improved device of forced recirculation of highly concentrated material contained in disintegrating beaters, more specifically its object is a paper pulp beater of the type having a cylindrical vat open at its upper part, and a rotor in the bottom over which rises a vertical shaft extending along the central axis of revolution of the vat inside the vat, the side wall of the vat having a pulp recirculation device, characterized in that the recirculation device includes at least one surface element extending substantially circularly along the wall of the beater, running from the wall toward the interior of the vat and toward the upper opening of the beater over a constant distance so as to form a band of constant width, one of the two faces of the element being oriented toward the bottom of the vat, so that the pulp encountering this face is diverted into the interior of the vat.

Other special features of the invention are the following:

The surface element is a closed circular rim forming a truncated cone extending from the wall toward the axis of the vat, inclined relative to the wall so as to form a truncated cone whose summit is on the side of the upper opening of the beater;

The recirculation device includes at least one surface element which extends helically along the wall of the beater, over at least 360°;

The recirculation device includes a plurality of surface elements which extend helically along the wall of the beater, the elements being disposed in a rim around the axis of the beater and forming vanes fixed relative to the rotor;

The surface elements extend and are disposed circularly at intervals without spacing so that their vertical projection forms a rim extending over 360°;

The surface elements extend partially overlapping on each other;

The angle of inclination of the surface element relative to the vertical wall of the beater is between 10° and 60 °, and preferably the angle is of the order of 35° to 45°;

the angle of inclination of the longitudinal axis of the spiral relative to the plane perpendicular to the axis of the beater is between about 10° and 30°, preferably of the order of 15°.

For better comprehension of the invention the annexed drawings show an example of realization of the device for forced recirculation of material in which.

Figure 1:
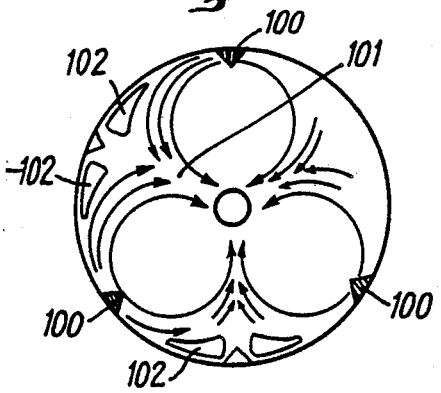
Fig. 1 (PRIOR ART)
FIG. 1 represents a top view of a beater equipped with the earlier device, in operation.

The beater illustrated in the drawing is of the helico type described in French patent FR-A 2 544,756, but this example of realization is not limiting and the invention relates to any type of beater.

The beater includes a cylindrical vat 1 open at its upper part, with central axis of revolution 2, equipped in its bottom with a rotor 3, itself carrying a shaft 4 which extends toward the upper opening along the axis 2 of the beater.

In the example, shaft 4 carries helical disks 5 which, with the rotation of the rotor, impart to the material 6 in suspension a vertical movement from top to bottom, the material being projected, at the bottom of the shaft, toward the lateral wall and then rising along the wall.

On the wall 9 a forced recirculation device 7 is disposed, intended to deviate the ascending stream of material along the wall and to orient it toward the upper end of shaft 4.

According to the invention, this forced recirculation device has at least one surface element 8, 21 extending substantially circularly along the wall 9 of the beater, running from wall 9 toward the interior of vat 1 and toward the upper opening 20 of the beater over a constant distance 12, 22 so as to form a band of constant width, one of the faces 8*a*, 24 of the element being oriented toward the bottom of the vat so that all of the material 6 encountering this face 8*a*, 24 is diverted and thrown back into the interior of the vat.

Figure 2:
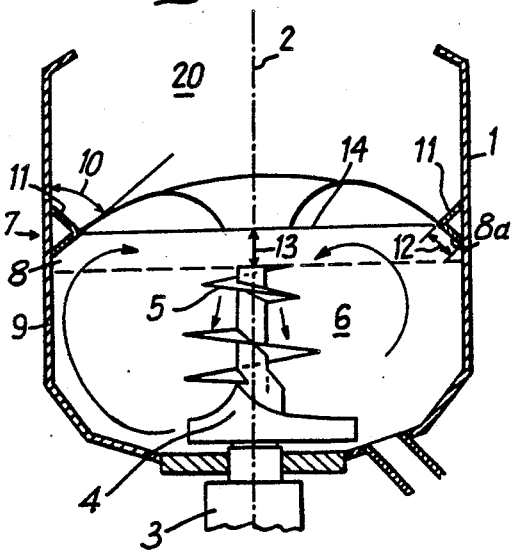
FIG. 2 represents a view in vertical section of a beater equipped with the forced recirculation device according to the invention in one variant of realization.

In a first form of realization illustrated in FIG. 2, the forced recirculation device 7 has a closed circular rim 8, that is, forming a ring; it extends from wall 9 toward the axis 2 of the vat, forming an angle 10 with wall 9 of the vat; the surface formed by this inclined rim 8 makes a truncated cone whose summit is on the side of the upper opening 20 of vat 1.

The angle 10 of inclination of this rim 8 with the wall is between 10° and 60° and in the example of realization the angle chosen is 45°.

The recirculation device according to this form of realization of FIG. 2 is an angle iron with two wings 8*a*, 11 forming between them a right angle. This angle iron is bent in a circle of the same outside diameter as the inside diameter of the vat, and the ends of the two wings of the angle iron are assembled on the side wall 9 by any known means, for example by welding. In this variant the wing 8*a* has the function of a deflecting rim.

The rim is mounted perpendicular to the axis 2 of the vat; the distance from the end of shaft 4 to the lower end of the rim (or to the upper end) is constant.

The width 12 of the rim is between 100 and 500 millimeters.

The distance 13 between the upper end of shaft 4 and plane 14 defined by the upper end circle of rim 8 varies between −500 and +500 millimeters.

This recirculation device permits attaining homogeneous concentrations of 20% of dry substance content and more;

the entire material is recirculated; there is no neutral zone where the pulp remains immobile, owing to the isotropic nature of the device;

it is possible to introduce, for the same quantity of water, up to 25% more paper.

And this higher concentration is obtained without involving the power consumed, that is, at constant power.

However, with this variant of realization one observes arch formation (vaulting) above the rotor when the material, deflected by the rim, moves toward the central axis 2. And because of the high density of the pulp, this arch remains immobile above the rotor without falling back into the beater, thus disabling the rotor which runs at no load.

To remedy this shortcoming, the arch formation is destroyed by cutting up the rim 8 into sections. In addition, each rim section, or element 21, is inclined upward in the direction of rotation of the rotor.

Figure 3:
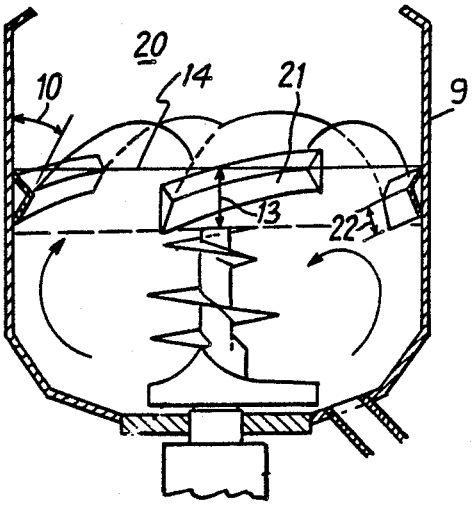
FIG. 3 represents a view in vertical section of the beater of FIG. 2 equipped with the device according to the invention in a second variant of realization.

FIG. 3 represents this second form of realization. The forced recirculation device includes at least one surface element 21 which extends helically along wall 9 of the beater.

According to the invention, there may be only one element 21; for example, rim 8 may be sectioned and curved helically, the ends being then no longer joined. In that case, the element extends at most over 350°. This variant destroys the isotropy of the deflection and suffices to avoid arch formation.

It may also be provided to arrange a plurality of surface elements 21 on the wall. These elements are disposed circularly in a rim around the axis 2, at intervals, like fixed vanes in front of which the rotor 4 rotates.

Figure 5:
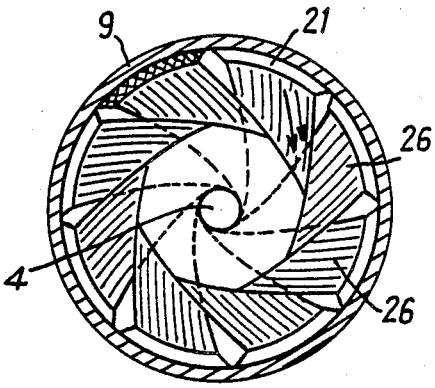
FIG. 5 represents a schematic top view of a beater equipped with the device according to the invention in the variant of FIG. 3, in operation.

The elements consist of a metal strip of constant width 22 which, according to the invention, extend from the wall toward the upper opening 20, forming an angle 10 with the vertical, on the one hand, and an angle 23 with the horizontal, on the other hand. This surface element follows the cylindrical wall of the beater forming a helicoidal deflection surface, one of whose face 24 is oriented toward the bottom of the vat; the pulp which encounters this surface element is deflected and diverted in the vat but in a direction comprised between the axis 2 and the wall, as FIG. 5 shows.

The surface elements are made either from an angle iron or from a sectional metal strip. The ends of each element 25 are closed by a matching triangular metal element.

Figure 4:
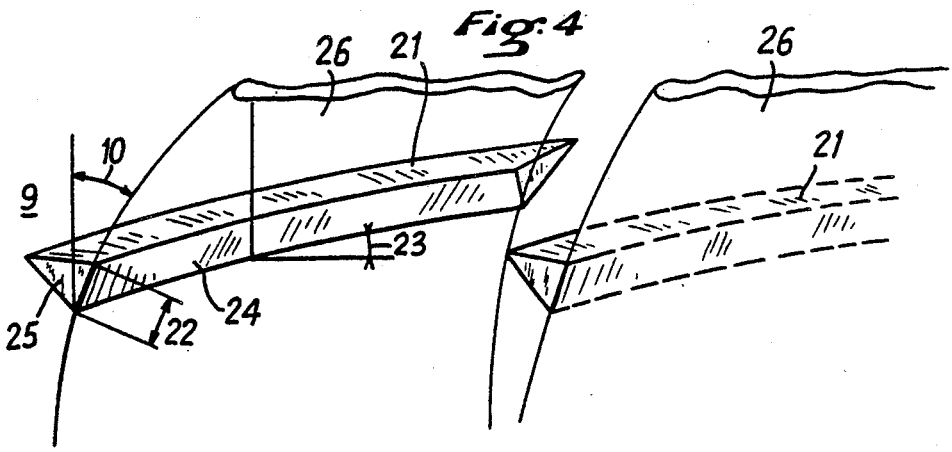
FIG. 4 represents a view in perspective of an element of the forced recirculation device according to the invention.

The number of elements 21 and their length are variable. They may follow each other leaving an empty interval between them (as illustrated in FIG. 3) or partially overlap (FIG. 4) to assure recirculation of all of the material.

The angle 10 of inclination of the surface element 21, as well as that of rim 8, with the wall 9, is between 10° and 60°, and preferably the angle is of the order of 35° to 45°.

The angle of inclination 23 of the longitudinal direction of the spiral with the plane perpendicular to the axis of the beater, that is, generally with the horizontal, is between about 10° and 30°, and is preferably of the order of 15°.

In operation, this variant gives the result illustrated in FIG. 5. As it rises, the pulp encounters the surface elements 21; each of them diverts the pulp that it receives and throws it back into the beater but deviating it relative to the center. Each blade of pulp 26 thus formed rises and falls back onto the adjacent blade and so on. Thus there is recirculation of the entire pulp without arch formation.

The results obtained are as astonishing as with a continuous rim: increase in concentration up to 25% of dry substance at least, and this at equal power.

It is seen, therefore, that the invention permits reducing the total treatment time of a global mass of paper (realized by a succession of treatments of identical lots of material) at unchanged consumption of energy, either by reducing the duration of each treatment at constant initial density, or by increasing the density and hence by a reduction of the number of lots to be treated.

I claim:

1. A paper pulp beater comprising:

a vat having a side wall and a bottom;

a rotor at the bottom;

a vertical rotor shaft rising from said bottom inside the vat and extending along a central axis of the vat, said side wall of the vat having means for forced recirculation of pulp in said vat, the recirculation means including at least one surface element extending substantially around the wall of the vat, said surface element having a face of constant width and running at an inclined angle from the wall toward the interior of the vat and toward the top of said vat, said face of the surface element being oriented toward the bottom of the vat, said surface element forming a band of constant width, pulp encountering said face being diverted into the interior of the vat.

2. Paper pulp beater according to claim 1, wherein the surface element is a closed circular rim, forming a truncated cone extending from the wall toward the axis of the vat, inclined relative to the wall so that the summit of the truncated cone is on the side of the upper opening of the vat.

3. Paper pulp beater according to claim 2, wherein the rim is disposed in a plane perpendicular to the axis of revolution of the vat.

4. A paper pulp beater according to claim 3, wherein the distance between the upper end of said rotor shaft and a plane defined by the upper end circle of the rim varies between −500 and +500 millimeters, said upper end circle being generated by positioning on said side wall one of discontinuous elements and a continuous surface element.

5. Paper pulp beater according to claim 1, wherein the recirculation device has at least one surface element which extends in a spiral along the wall of the vat, over at most 360°.

6. Paper pulp beater according to claim 5, wherein surface elements are disposed in a rim about the axis of the vat and this rim is disposed in a plane perpendicular to said axis.

7. Paper pulp beater according to claim 6, wherein the distance between the upper end of the rotor shaft and a plane defined by the upper end circle of the rim varies between −500 and +500 millimeters, the upper end circle of the rim is generated by positioning one of discontinuous surface elements and a continuous surface element on said side wall.

8. Paper pulp beater according to claim 5, wherein surface elements extend and are arranged circularly at intervals with spacing in such a way that their vertical projection forms a succession of rim sections.

9. A paper pulp beater according to claim 8, wherein the distance between the upper end of said rotor shaft and a plane defined by the upper end circle of the rim varies between −500 and +500 millimeters, said upper end circle being generated by positioning on said side wall one of discontinuous elements and a continuous surface element.

10. Paper pulp beater according to claim 5, wherein surface elements extend and are arranged circularly partially over-lapping on each other so that their vertical projection forms an uninterrupted closed rim.

11. A paper pulp beater according to claim 10, wherein the distance between the upper end of said rotor shaft and a plane defined by the upper end circle of the rim varies between −500 and +500 millimeters, said upper end circle being generated by positioning on said side wall one of discontinuous elements and a continuous surface element.

12. Paper pulp beater according to claim 1, wherein the angle of inclination of the surface element relative to the side wall of the vat is between 10° and 60°.

13. A paper pulp beater according to claim 7, wherein the distance between the upper end of said rotor shaft and a plane defined by the upper end circle of the rim varies between −500 and +500 millimeters, said upper end circle being generated by positioning on said side wall one of discontinuous elements and a continuous surface element.

14. Paper pulp beater according to claim 12, wherein the angle of inclination is between 35° and 45°.

15. A paper pulp beater according to claim 8, wherein the distance between the upper end of said rotor shaft and a plane defined by the upper end circle of the rim varies between −500 and +500 millimeters, said upper end circle being generated by positioning on said side wall one of discontinuous elements and a continuous surface element.

16. Paper pulp beater according to claim 1, wherein the angle of inclination of the longitudinal direction with the plane perpendicular to the axis of the vat is between 10° and 30°.

17. A paper pulp beater according to claim 9, wherein the distance between the upper end of said rotor shaft and a plane defined by the upper end circle of the rim varies between −500 and +500 millimeters, said upper end circle being generated by positioning on said side wall one of discontinuous elements and a continuous surface element.

18. Paper pulp beater according to claim 1, wherein the width of the surface element is between 100 and 500 millimeters.

19. A paper pulp beater according to claim 18, wherein the distance between the upper end of said rotor shaft and a plane defined by the upper end circle of the rim varies between −500 and +500 millimeters, said upper end circle being generated by positioning on said side wall one of discontinuous elements and a continuous surface element.

* * * * *